US006095249A

United States Patent [19]

McGarian et al.

[11] Patent Number: 6,095,249

[45] Date of Patent: Aug. 1, 2000

[54] DOWN HOLE BYPASS VALVE

[76] Inventors: Bruce McGarian, 23 East Glebe, Stonehaven, Aberdeen AB3 2HW; Rory McCrae Tulloch, 20 Ashley Park North, Aberdeen AB1 6SF; Lawrence Robert Barr, Barclayhiss Steading East, Findon, Aberdeen, AB12 4RL, all of United Kingdom

[21] Appl. No.: 09/077,830

[22] PCT Filed: Dec. 9, 1996

[86] PCT No.: PCT/GB96/03027

§ 371 Date: Jun. 4, 1998

§ 102(e) Date: Jun. 4, 1998

[87] PCT Pub. No.: WO97/21020

PCT Pub. Date: Jun. 12, 1997

[30] Foreign Application Priority Data

Dec. 7, 1995 [GB] United Kingdom ..... 9525008

[51] Int. Cl.[7] ..... E21B 34/10

[52] U.S. Cl. ..... 166/319; 166/320; 166/324; 166/331

[58] Field of Search ..... 166/319, 321, 166/320, 324, 240, 331

[56] References Cited

U.S. PATENT DOCUMENTS

| | | | |
|---|---|---|---|
| Re. 17,424 | 9/1929 | Pivoto . | |
| 3,823,773 | 7/1974 | Nutter | 166/152 |
| 4,113,012 | 9/1978 | Evans et al. | 166/264 |
| 4,286,659 | 9/1981 | Bolding, Jr. | 166/205 |
| 4,298,077 | 11/1981 | Emery | 174/65 |
| 4,403,659 | 9/1983 | Upchurch | 166/374 |
| 4,429,755 | 2/1984 | Williamson | 175/314 |
| 4,633,952 | 1/1987 | Ringgenberg | 166/336 |
| 4,718,494 | 1/1988 | Meek | 166/373 |
| 4,749,044 | 6/1988 | Skipper et al. | 166/323 |
| 4,791,991 | 12/1988 | Morris et al. | 166/319 |
| 5,010,955 | 4/1991 | Springer | 166/298 |
| 5,271,461 | 12/1993 | Decker et al. | 166/185 |
| 5,443,129 | 8/1995 | Bailey et al. | 175/45 |
| 5,609,178 | 3/1997 | Henning et al. | 137/10 |
| 5,890,540 | 4/1999 | Pia et al. | 166/321 |
| 5,901,796 | 5/1999 | McDonald | 175/57 |

FOREIGN PATENT DOCUMENTS

| | | |
|---|---|---|
| 2659384 | 9/1991 | France . |
| WO 96/30621 | 10/1996 | WIPO . |

*Primary Examiner*—Hoang Dang
*Attorney, Agent, or Firm*—Watson Cole Grindle Watson

[57] ABSTRACT

The invention relates to bypass valves for use in wellbores, particularly but not exclusively to bypass valves used during the setting of hydraulic anchor packers. The invention provides a bypass valve for selectively isolating the interior of a down-hole assembly from the exterior thereof, the bypass valve comprising guide pin in received slot being adapted to permit movement of a piston (30) from a first position to a second position in response to a predetermined pressure differential between a bore (58) of the piston (30) and the exterior of a body (4) but normally preventing movement of the piston (30) to a third position in which the bore (58) of the piston (30) is substantially isolated from the exterior of the body (4), and an extension of the guide slot for overriding the guide pins in the slot, so as to permit movement of the piston (30) to the third position. The invention thereby provides a bypass valve which resists any tendency to close prematurely and which communicates any such tendancy to the surface.

10 Claims, 3 Drawing Sheets

DOWN HOLE BYPASS VALVE

The invention relates to bypass valves for use in wellbores, particularly but not exclusively to bypass valves used during the setting of hydraulic anchor packers.

The drilling industry often has the need to monitor the axial position and angular orientation of a tool (such as a whipstock) within a wellbore, and to rigidly secure the tool within the wellbore once a required position and orientation has been achieved. The position and orientation of a tool may be determined by using a MWD or Measurement-While-Drilling tool. An MWD tool requires a flow of wellbore fluid through a drill string in order to communicate a measured position and orientation to the surface. The flow rates required are often sufficiently high to generate a pressure drop between the inside and the outside of the drill string to prematurely set the hydraulic anchor packer.

To overcome this problem, drill strings are often provided with a bypass valve located between the MWD tool and the anchor packers. When the position and orientation of the drill string is being monitored, wellbore fluid is pumped through the MWD tool via the bore in the drill string. The bypass valve prevents the setting of the anchor packers by allowing the wellbore fluid flowing downhole of the MWD tool to pass into the wellbore annulus. The fluid pressure differential across the hydraulic anchor packer is thereby maintained below the setting pressure.

Once the required drill string position and orientation is obtained, the hydraulic anchor packer is set by increasing the flow rate of the wellbore fluid down the drill string. The increase in flow rate results in an associated increase in dynamic pressure. Once the dynamic pressure increases to a predetermined magnitude, the bypass valve is activated and the fluid path between the wellbore annulus and the drill string bore is closed. The wellbore fluid is thereby directed downhole to the anchor packers where the appropriate setting pressure (typically a 1500–3000 psi differential between the inside and outside of the anchor packer) is then applied.

A conventional bypass valve incorporates a piston which slides within a cylinder in response to dynamic wellbore fluid pressure. The wall of the cylinder is provided with a plurality of holes through which fluid may pass from the drill string bore to the wellbore annulus. The piston is held in an open position by biasing means, such as a spring or a shear pin, or a combination of both. When the appropriate dynamic pressure is achieved, the biasing means is overcome and the piston slides within the cylinder so as to sealingly close the plurality of holes.

This type of bypass valve can be problematic when the wellbore fluid within the drill string carries a large amount of debris. This debris may be either pumped from the surface by accident, produced by component failure in the MWD tool or generated during the drilling of the wellbore. The debris can accumulate on the piston and increase the force exerted on the piston by any given flow rate of wellbore fluid. In certain circumstances, the accumulation of debris can be sufficient to cause the bypass valve to close prematurely. This in turn causes a premature setting of the hydraulic anchor packers. Premature setting can also occur if the piston biasing means in the bypass valve fails.

It is an object of the present invention to provide a bypass valve for use in a wellbore which resists any tendency to close prematurely and which communicates any such tendency to the surface.

The present invention provides a bypass valve for selectively isolating the interior of a down-hole assembly from the exterior thereof, the bypass valve comprising: a body incorporating a wall provided with at least one opening extending therethrough; a piston slidably mounted in the body; a longitudinal bore extending through the piston; a first position of the piston relative to the body establishing a passage from the bore of the piston to the exterior of the body via the opening; a second position of the piston relative to the body establishing a restricted passage from the bore of the piston to the exterior of the body via the opening; a third position of the piston relative to the body substantially isolating the bore of the piston from the exterior of the body; constraining means for controlling movement of the piston between the first, second and third positions, the constraining means being adapted to permit movement of the piston from the first position to the second position in response to a predetermined pressure differential between the bore of the piston and the exterior of the body but normally preventing movement of the piston to the third position; and overriding means for overriding the constraining means so as to permit movement of the piston to the third position.

The piston is preferably biased to the first position by means of a spring. Furthermore, the piston may incorporate a wall provided with at least one opening extending therethrough so that, in the first position the openings of the piston and body are in register, and in the second position the openings of the piston and the body are partly in register.

Preferably the constraining means comprises a guide pin and a guide slot for receiving the guide pin. The guide slot is preferably provided about the outer peripheral surface of the piston and extends in a direction having one component parallel to the direction of axial movement of the piston. The overriding means may be provided by an extension of the guide slot.

Preferably the guide pin is fixedly located relative to the body and the guide slot is formed in the exterior surface of the piston.

Connecting means may be provided for connecting a nozzle to the piston. Furthermore, a filter may be provided adjacent the or each opening of the body. It may also be desirable to provide a filter for filtering a fluid flowing into the bore of the piston.

The bypass valve provided by the present invention has the advantage over the conventional bypass valves of not closing prematurely due to the presence of debris in the drill string or the failure of the means biasing the bypass valve to the open position. An appropriate accumulation of debris or a failure of the biasing means results in the movement of the bypass valve to a partially closed position in which wellbore fluid is still able to flow to the wellbore annulus. The flow area through the bypass valve is thereby reduced which leads to a pressure rise of approximately 300–600 psi experienced at the surface. This pressure rise provides an indication that the bypass valve has attempted to close prematurely, but is not sufficient to set the anchor packers. The warning received by way of the pressure rise may be acted upon by taking remedial action such as decreasing the flow rate of wellbore fluid down the drill string. The position and orientation of the drill string may continue to be adjusted even though the bypass valve has attempted to close prematurely.

Embodiments of the present invention will now be described with reference to the accompanying drawings, in which.

Figure 1:
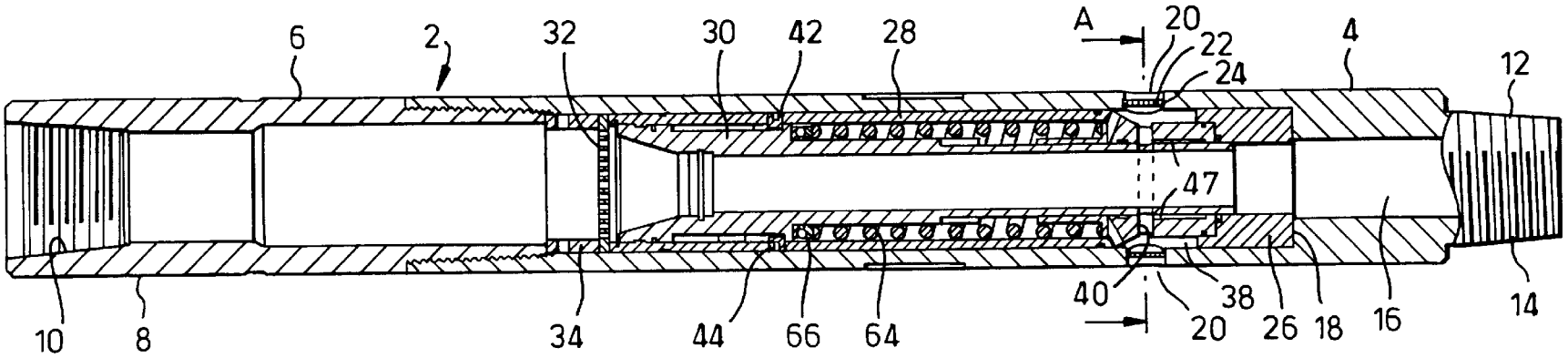
FIG. 1 is a cross-sectional side view of a first embodiment of the present invention.

A first embodiment of the present invention is shown in FIG. 1. The embodiment of FIG. 1 is a bypass valve defined by a plurality of internal parts mounted within a shell 2.

Figure 3:
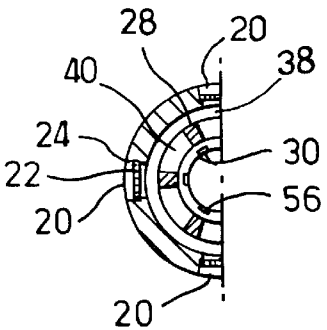
FIG. 3 is a cross-sectional view of the first embodiment of FIG. 1 taken along line A—A.

The shell 2 comprises a casing 4 threadedly connected to a crossover member 6. The upper end 8 of the crossover member 6 is provided with an internal screw thread 10. Assemblies to be arranged up-hole of the bypass valve are connected to the crossover member 6 by means of the internal screw thread 10. The lower end 12 of the casing 4 is provided with an external thread 14. Assemblies to be arranged down-hole of the bypass valve are connected to the casing 4 by means of the external thread 14. The casing 4 and the crossover member 6 define a bore 16 in which the internal parts of the bypass valve are located. The portion of the bore 16 defined by the casing 4 is provided with a shoulder 18 which prevents undesirable axial movement of the internal parts towards the lower end 12. Four vent holes 20 are provided in the casing 4 which are arranged coplanar, up-hole of the shoulder 18 and equispaced about the circumference of the bore 16. The vent holes 20 allow fluid to either enter the bypass valve from the wellbore annulus or enter the wellbore annulus from the bypass valve. Each vent hole 20 is provided with a filter disc 22 held in position by means of a filter disc circlip 24. The arrangement of the vent holes 20 is shown in FIG. 3.

The plurality of internal parts include a seal housing 26, a sleeve 28, a piston 30, an internal filter 32 and an adjusting ring 34. The seal housing 26 is substantially cylindrical in shape and has an outer diameter similar to the diameter of the bore 16 defined by the portion of the casing 4 up-hole of the shoulder 18. The seal housing 26 is located down-hole of the vent holes 20 and is arranged so as to abut the shoulder 18.

Figure 4:
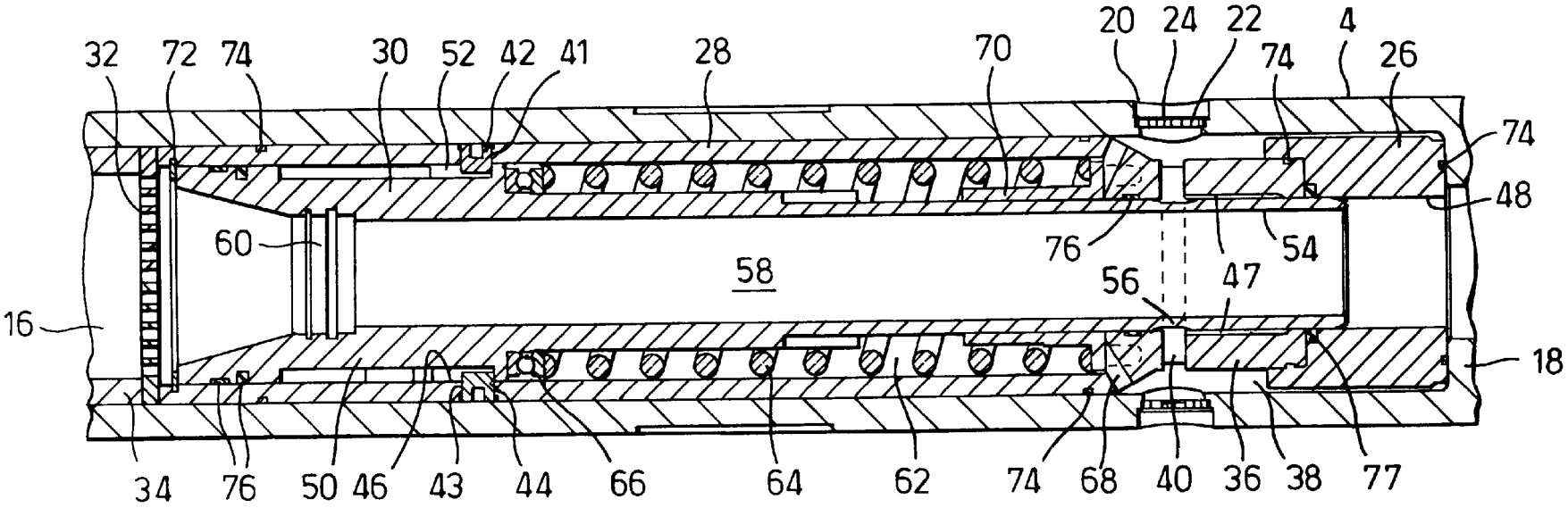
FIG. 4 is a large scale cross-sectional side view of the first embodiment of FIG. 1.

The sleeve 28 is also substantially cylindrical in shape, the upper end thereof having an outer diameter similar to that of the seal housing 26. The lower end 36 (see FIG. 4) of the sleeve 28 has an outer diameter which is less than that of the seal housing 26. The sleeve 28 is arranged within the casing 4 with the lower end 36 of the sleeve 28 located in abutment with the seal housing 26. A vent chamber 38 in fluid communication with the vent holes 20 is thereby defined by the lower end 36 of the sleeve 28, the seal housing 26 and the casing 4. FIG. 3 shows that the vent chamber 38 defines an annulus shape and is located between the sleeve 28 and the casing 4. The vent chamber 38 is also in fluid communication with a plurality of vent chamber ports 40. The vent chamber ports 40 are provided in the form of slots located in a recess 47 defined the lower end 36 of the sleeve 28.

The upper end of the sleeve 28 is provided with two guide pin holes 41, 43 which are arranged on opposite sides of the sleeve 28. Guide pin 42, 44 are a push fit within the bores 41, 43 and are provided with blind screw threaded recesses for receiving an extractor tool. The guide pins 42, 44 extend from the inner surface 46 of the sleeve 28.

Figure 2:
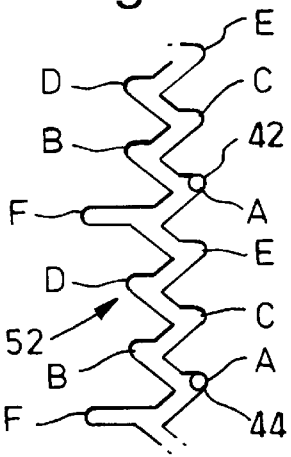
FIG. 2 is a plan view of the unwrapped profile of the guide slot of the first embodiment of FIG. 1.

The piston 30 is located in abutment with the inner surface 46 of the sleeve 28 and the inner surface 48 of the seal housing 26. The arrangement is such that the piston 30 may rotate and move axially within the sleeve 28 and the seal housing 26. The upper end 50 of the piston 30 is provided with a guide slot 52 in which the guide pins 42, 44 are located. The guide slot 52 has an unbroken profile defined around the circumference of the upper end 50 of the piston 30. The unwrapped profile of the guide slot 52 is shown in FIG. 2. The location of the guide pins 42, 44 in the guide slot 52 limits the movement of the piston 30 relative to the sleeve 28. The lower end 54 of the piston 30 extends beyond the vent chamber ports 40 and is provided with a plurality of piston holes 56 in the form of elongated slots. The piston holes 56 allow wellbore fluid to pass from the vent chamber 38 to a piston bore 58 defined by the piston 30. The upper end 50 of the piston 30 is also provided with connecting means 60 which allow the attachment of an appropriate nozzle (not shown) to the piston 30 so as to effectively reduce the diameter of the piston bore 58. The attachment of a nozzle to the piston 30 reduces the flow rate of wellbore fluid required to move the piston 30 axially within the sleeve 28. The flow rate at which the bypass valve closes may therefore be varied with the inclusion of a suitable nozzle.

The piston 30 and the sleeve 28 define a piston spring chamber 62 in which a piston spring 64 is located. The piston spring 64 abuts the lower end 36 of the sleeve 28 and the upper end 50 of the piston 30, and is arranged so as to bias the piston 30 towards the upper end 8 of the crossover member 6. A ball bearing assembly 66 is provided between the piston spring 64 and the upper end 50 of the piston 30 so as to reduce to a minimum any transfer of torque from the piston 30 to the piston spring 64. Axial movement of the piston 30 is assisted by the venting of the piston spring chamber 62 to the vent chamber 38 by means of piston spring chamber ports 68. The piston spring chamber ports 68 take the form of holes provided in the lower end 36 of the sleeve 28 providing fluid communication between the piston spring chamber 62 and the vent chamber 38. The axial movement of the piston 30 is restricted by a piston stop 70 and a piston circlip 72, and also by the location of the guide pins 42, 44 within the guide slot 52.

The internal filter 32 is located up-hole of the piston 30 between the sleeve 28 and the adjusting ring 34. The internal filter 32 is capable of filtering debris having a dimension greater than ⅛ inch. The adjusting ring 34 extends up-hole of the internal filter 32 so as to abut the crossover member 6. Seals 74 are provided in order to prevent undesirable ingress of wellbore fluid. Glyd ring seals 76, 77 are also provided to assist with the movement of piston 30 within the sleeve 28 and the seal housing 26.

The components of the bypass valve are manufactured from a suitable grade of steel. The interfacing portions of the lower end 36 and the piston 30 are coated with tungsten carbide so as to improve the wear resistant characteristics of the bypass valve. The glyd ring seals are manufactured from PTFE. Alternative materials will be apparent to a reader skilled in the art.

The bypass valve of FIGS. 1, 2, 3 and 4 is assembled by sliding the piston stop 70, the piston spring 64, the ball bearing assembly 66 and the piston 30 into the sleeve 28. The piston circlip 72 is then located in position so as to prevent the piston spring 64 from pushing the piston 30 from the sleeve 28. The guide pins 42, 44 are located within the guide slot 52 by aligning the guide pin holes 41, 43 with the guide slot 52 and then screwing the guide pins 42, 44 into the guide pin holes 41, 43. A piston assembly is thereby defined. The seal housing 46, the piston assembly, the internal filter 32 and the adjusting ring 34 are then slid into the casing 4. The crossover member 6 is then threadedly connected to the casing 4. The crossover member 6 abuts the adjusting ring 34 so as to press the adjusting ring 34, the internal filter 32, the sleeve 28 and the seal housing 26 against the shoulder 18. Movement of the sleeve 28 relative to the casing 4 is thereby prevented.

The operation of the bypass valve will now be described with reference to a drill string incorporating an MWD tool, the bypass valve, a whipstock and a hydraulic anchor packer.

FIGS. 1, 2, 3 and 4 show the bypass valve in an open configuration in which the piston holes 56 are directly aligned with the vent chamber ports 40. In this configuration, wellbore fluid is able to flow from the piston bore 58 to the wellbore annulus, or vice versa. The bypass valve is arranged in an open configuration when the guide pins 42, 44 are located at positions A, C or E within the guide slot 52.

The bypass valve is run into a wellbore arranged in an open configuration. In so doing, wellbore fluid enters the drill string through the vent holes 20. Debris, such as drill cuttings, is prevented from entering the drill string by means of the filter discs 22. The filter discs 22 comprise a plurality of holes small enough to prevent the passage therethrough of any debris likely to hinder the operation of the bypass valve or any other part of the drill string. The flow of wellbore fluid into the bypass valve equalises the very high hydrostatic pressures exerted on the outer surface of the drill string.

The wellbore fluid held within the drill string is circulated down the drill string bore at a predetermined flow rate. The flow rate is sufficient for the operation of the MWD tool, but not high enough to generate the dynamic pressure required to activate the bypass valve. Consequently, wellbore fluid is pumped from the surface, through the MWD tool, into the wellbore annulus via the vent holes 20, and up the wellbore annulus to the surface. The hydraulic anchor packers are not thereby exposed to the required setting pressure differential.

The risk of premature activation of the bypass valve is reduced by the internal filter 32. The internal filter 32 reduces the likelihood of debris accumulating on the piston 30 and blocking the piston bore 58. In conventional bypass valves, debris accumulation can readily occur resulting in an increase in the force exerted on the bypass valve piston at any given flow rate. If the debris accumulation on the piston is severe, then the piston of a conventional bypass valve can move unexpectedly. Premature setting of the anchor packer may result. Although the internal filter 32 reduces the risk of this occurring, it is possible for very fine debris to still accumulate on the piston 30. If sufficient debris accumulates, then piston 30 may be unexpectedly moved towards a closed position in which the piston 30 prevents the flow of wellbore fluid through the vent holes 20. The piston 30 may also move in this manner if the piston spring 64 fails.

Movement of the piston 30 relative to the sleeve 28 is restricted by the location of the guide pins 42, 44 within the guide slot 52. If the piston 30 unexpectedly moves towards a closed position, then the guide pins 42, 44 move from position A within the guide slot 52 to position B. In so doing, the piston 30 rotates within the sleeve 28 and moves axially to a part closed position in which the piston holes 56 are not aligned with the vent chamber ports 40, but are in fluid communication with the vent chamber ports 40 by means of the recess 47. Axial movement of the piston 30 is assisted by a venting of wellbore fluid from the spring chamber 62 via the piston spring chamber ports 68. The movement of the piston 30 into the part closed position generates a pressure rise of approximately 300–600 psi which may be measured at the surface. The pressure rise is sufficient to provide a clear indication at the surface that the bypass valve has moved into a part closed configuration, but not sufficient to generate the pressure differential of 1500–3000 psi required to set the hydraulic anchor packer.

If a pressure rise of approximately 300–600 psi is measured at the surface, then it is likely that the bypass valve has moved into a part closed configuration due to debris accumulation on the piston 30 or failure of the piston spring 64. Appropriate remedial action may then be undertaken. Such action may involve reducing the flow rate of wellbore fluid down the drill string bore. Provided the piston spring 64 has not failed, the piston spring 64 will then push the piston 30 back to an open position. In so doing, the guide pins 42, 44 move from position B to position C within the guide slot 52.

Once the required position and orientation of the whipstock has been obtained, the hydraulic anchor packer is set by moving the bypass valve into a closed configuration. In the closed configuration, the piston holes 56 are located down-hole of the seal 77 so as to prevent the flow of wellbore fluid between the piston bore 58 and the wellbore annulus. The bypass valve is closed by cycling the piston 30 so that the guide pins 42, 44 locate in position F within the guide slot 52. This is achieved by stopping the flow of wellbore fluid down the drill string bore to ensure that the guide pins 42, 44 are located at one of positions A, C or E within the guide slot 52 by the action of the spring. The flow rate is then increased to move the piston 30 axially and thereby move the guide pins 42, 44 to one of positions B, D or F. The process is repeated as necessary until the guide pins 42, 44 locate in position F within the guide slot 52. In this position, the piston 30 sealingly closes the vent chamber ports 40. The required setting pressure differential is then generated at the anchor packer. The movement of the piston 30 into the closed position produces a large pressure rise at the surface which may serve as an indication that the anchor packers have been set. This may be confirmed by attempting to move the drill string within the wellbore.

Figure 5:
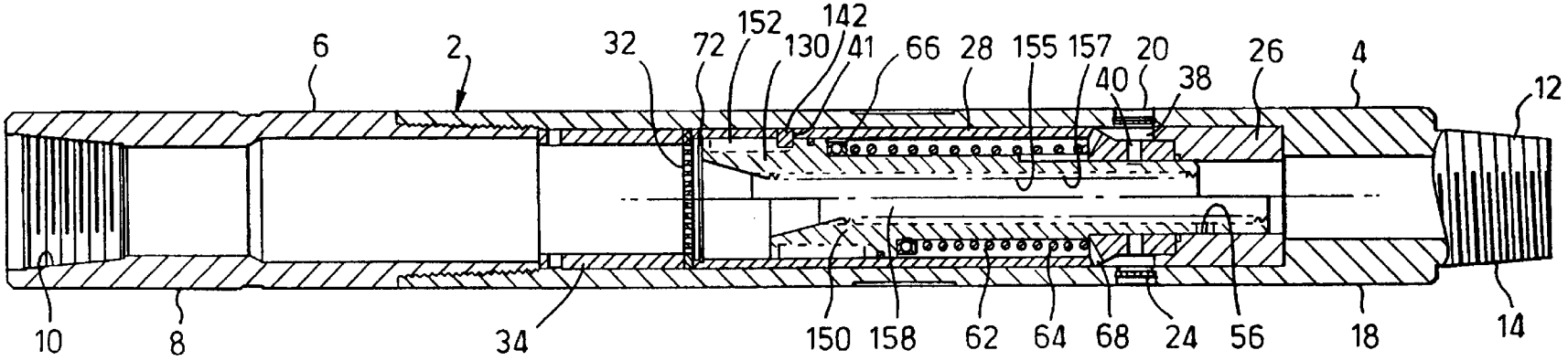
FIG. 5 is a cross-sectional side view of a second embodiment of the present invention.
Figure 6:
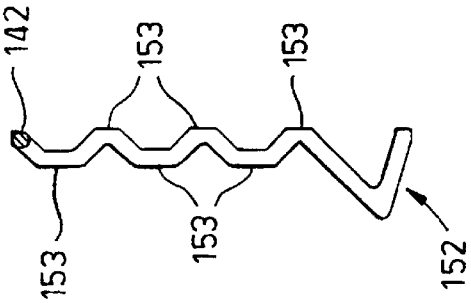
FIG. 6 is a plan view of the unwrapped profile of the guide slot of the second embodiment of FIG. 5.

A second embodiment of the present invention is shown in FIGS. 5 and 6. FIG. 5 shows a split view of a piston 130. The top half of the figure shows the piston 130 in an open position, and the bottom half of the figure shows the piston 130 in a closed position.

The upper end 150 of the piston 130 is provided with a guide slot 152 in which one guide pin 142 is located. The guide slot 152 has a number of circumferential portions 153. Each circumferential portion 153 extends perpendicularly to the axial direction in which the piston 130 moves. The internal surface 155 of the piston 130 is provided with an internal bore thread 157. The wellbore fluid flowing through the piston bore 158 interacts with the internal bore thread 157 so as to impart a torque onto the piston 130. The torque tends to rotate the piston 130 so that the guide pin 142 slides along the circumferential portions 153 of the guide slot 152.

Torque can be most efficiently imparted onto the piston 130 by providing an internal bore thread 157 which generates a "spiral staircase" type of fluid flow. The internal bore thread 157 may be provided by casting the internal surface 155 of the piston 130 using a male spiral moulding core piece. Alternatively, a "spiral staircase" fluid flow could be generated by locating a rod, provided with a female thread, within the piston bore 158. A spiral flow is thereby generated about the rod.

The operation of the second embodiment is similar to that of the first embodiment.

Further variations and alternatives will be apparent to a reader skilled in the art. For example, the internal filter 32 could be replaced, or added to, by inserting a three to four foot long standard drill pipe filter into a housing attached to the bypass valve assembly. The long length of the tubular filter pipe allows debris to collect without a significant pressure rise. Furthermore, the guide slot may be altered so that the piston must pass through an alternative number of part closed positions before moving to a fully closed position.

We claim:

1. A bypass valve for selectively isolating the interior of a down-hole assembly from the exterior thereof, the bypass valve comprising: a body incorporating a wall provided with at least one opening extending therethrough; a piston slidably mounted in the body; a longitudinal bore extending through the piston; a first position of the piston relative to the body establishing a passage from the bore of the piston to the exterior of the body via the opening; a second position of the piston relative to the body establishing a restricted passage from the bore of the piston to the exterior of the body via the opening; a third position of the piston relative to the body substantially isolating the bore of the piston from the exterior of the body; constraining means for controlling movement of the piston between the first, second and third positions, the constraining means being adapted to permit movement of the piston from the first position to the second position in response to a predetermined pressure differential between the bore of the piston and the exterior of the body but normally preventing movement of the piston to the third position; and overriding means for overriding the constraining means so as to permit movement of the piston to the third position.

2. A bypass valve as claimed in claim 1, wherein the piston is biased to the first position by means of a spring.

3. A bypass valve as claimed in claim 1, wherein the piston incorporates a wall provided with at least one opening extending therethrough such that, in the first position the openings of the piston and the body are in register, and in the second position the openings of the piston and the body are partly in register.

4. A bypass valve as claimed in claim 1, wherein the constraining means comprises a guide pin and a guide slot for receiving the guide pin.

5. A bypass valve as claimed in claim 4, wherein the guide slot is provided about the outer peripheral surface of the piston and extends in a direction having one component parallel to the direction of axial movement of the piston.

6. A bypass valve as claimed in claim 4, wherein the overriding means comprises an extension of the guide slot.

7. A bypass valve as claimed in claim 4, wherein the guide pin is fixedly located relative to the body and the guide slot is formed in the exterior surface of the piston.

8. A bypass valve as claimed in claim 1, wherein connecting means is provided for connecting a nozzle to the piston.

9. A bypass valve as claimed in claim 1, wherein a filter is provided adjacent the or each opening of the body.

10. A bypass valve as claimed in claim 1, wherein a filter is provided so as to filter a fluid flowing into the bore of the piston.

* * * * *